United States Patent [19]

Chi Yu

[11] Patent Number: 4,951,729

[45] Date of Patent: Aug. 28, 1990

[54] VENETIAN BLIND STRUCTURE

[76] Inventor: Simon S. Chi Yu, 3165 California St., Oakland, Calif. 94602

[21] Appl. No.: 343,906

[22] Filed: Apr. 26, 1989

[51] Int. Cl.[5] ..... E06B 9/38

[52] U.S. Cl. ..... 160/178.3; 160/168.1; 160/236

[58] Field of Search ..... 160/236, 178.3, 168.1, 160/176.1, 84.1

[56] References Cited

U.S. PATENT DOCUMENTS 1,937,342 11/1933 Higbie ..... 160/236
4,544,011 10/1985 Sawamura ..... 160/84.1

FOREIGN PATENT DOCUMENTS 884708 11/1971 Canada ..... 160/236

*Primary Examiner*—Blair M. Johnson
*Attorney, Agent, or Firm*—Bielen, Peterson & Lampe

[57] ABSTRACT

A venetian blind structure using a slat unit having first and second members adjacent one another. The edge portions of the first and second members are hingedly attached to one another. First and second lines are held to the edge portions of the slat unit and are used to tilt the slat when a first and second line are simultaneously pulled in opposite directions.

10 Claims, 3 Drawing Sheets

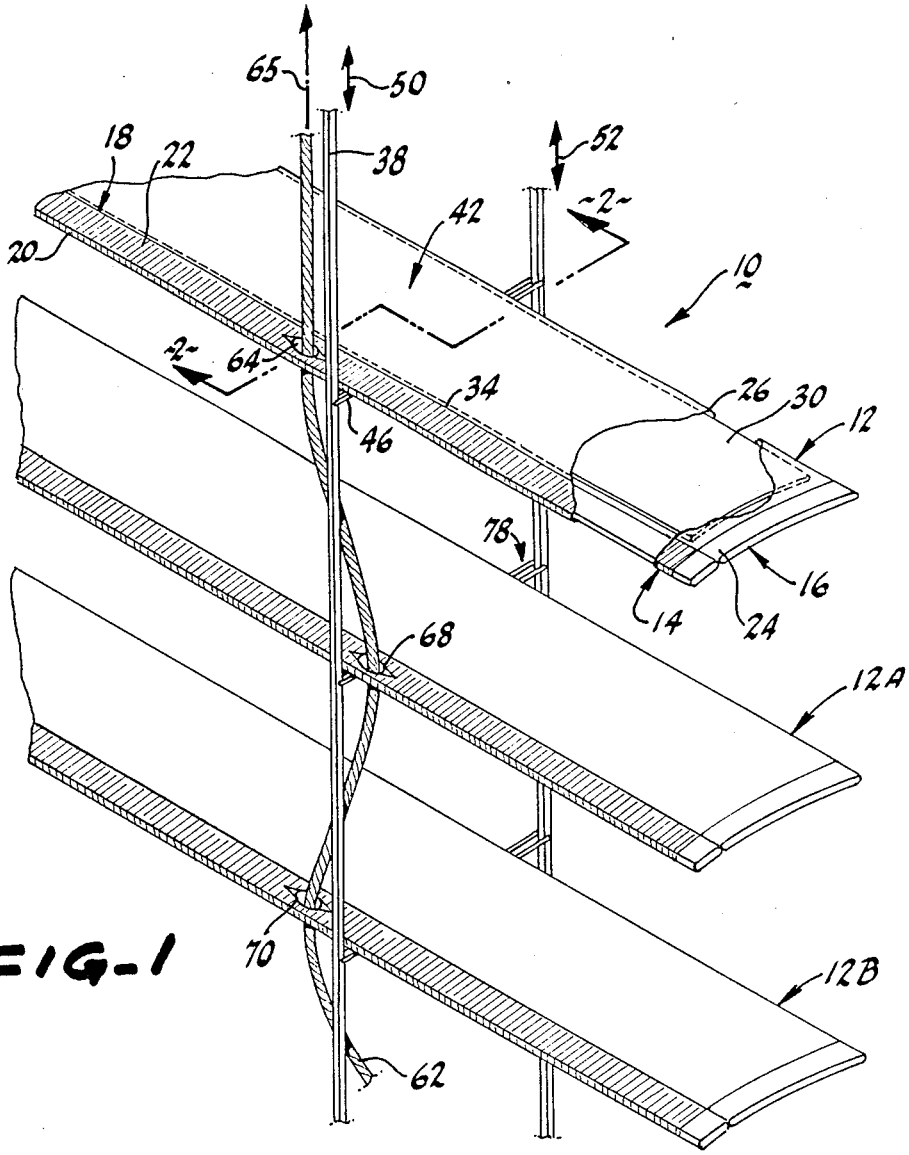
FIG-1
FIG-3
PRIOR ART
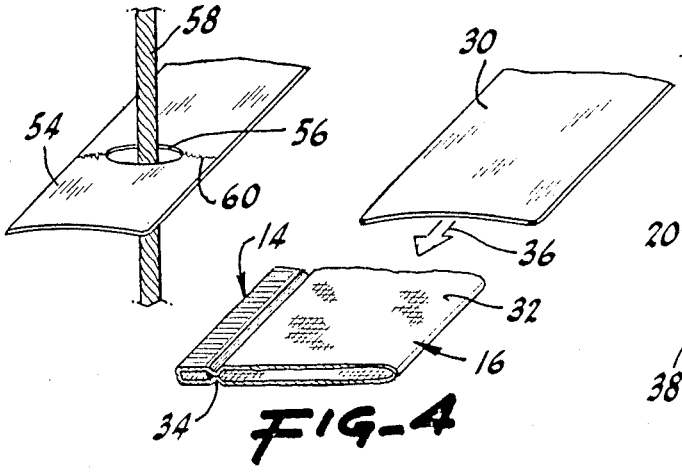
FIG-4
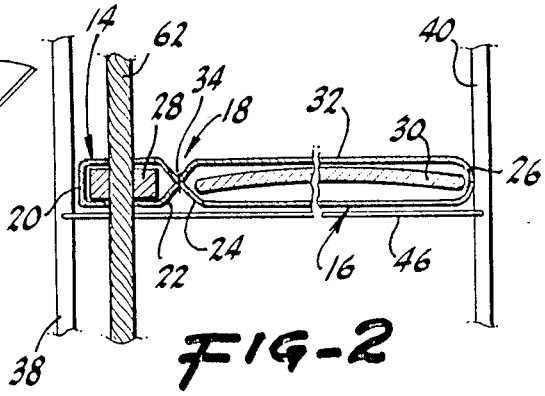
FIG-2

FIG-12
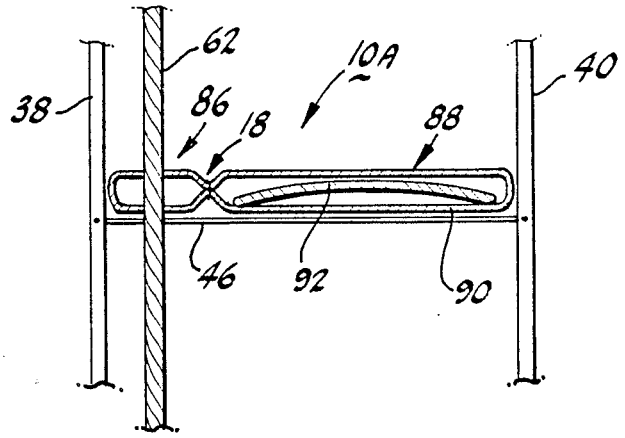
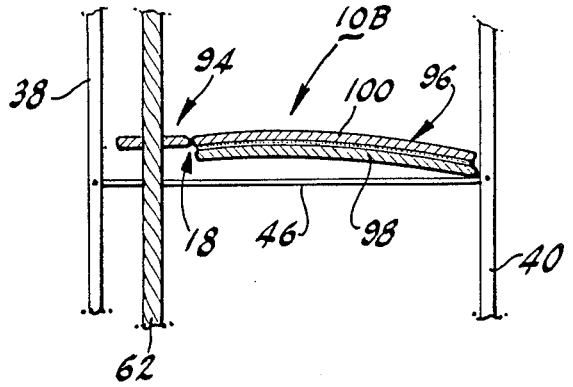
FIG-13
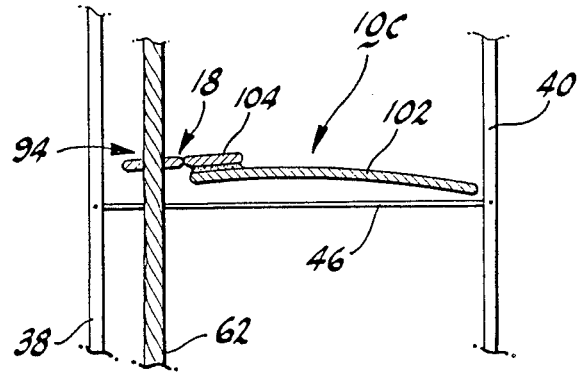
FIG-14

VENETIAN BLIND STRUCTURE

CROSS-REFERENCES TO RELATED APPLICATIONS

The present application is related to my co-pending application Ser. No. 232,596, filed 15 Aug. 1988 now abandoned.

BACKGROUND OF THE INVENTION

The present invention concerns a novel venetian blind structure.

Venetian blinds have always been a popular method of regulating heat, light, and ventilation through a window or door. For example, U.S. Pat. No(s). 3,918,513 and 4,567,930 depict venetian blinds as well as "mini-blinds" which have been employed in the past.

Known venetian blind systems generally employ center holes in the slats to lift the blinds in stacking relationship or to lower the blinds to again spread the slats. Although such center holes are convenient, they often bend or break the slats after usage for a period of time. Unfortunately, slats are extremely difficult to repair and, often, a broken slat requires the replacement of the entire venetian blind system. Also, conventional venetian blinds do not fully close leaving an air gap that permits heat, sound, and light to pass through the blinds either into or out of the room having the window employing such blinds. In addition, the air gap provides the appearance of the venetian blinds being partially open, which may or may not be a desirable esthetic feature.

A venetian blind system which overcomes the problems encountered in the prior art would be a great advance in the field of building environmental control.

SUMMARY OF THE INVENTION

In accordance with the present invention a novel and useful venetian blind structure is provided.

The structure of the present invention utilizes a slat unit having a first member with first and second edge portions. The slat unit also includes a second member having first and second edge portions such that the second edge portion of the first member is hingedly attached to the first edge portion of the second member. The slat unit may be formed of a pair of core members covered by soft material which is closed along the gap between the edge portions of the core members. Thus, a hinge is formed by such a combination of elements.

A first and second line is also employed relative the first and second members of the slat unit. Means is provided for holding the first line relative to the first member and holding the second line relative to second member. Such first and second lines may be formed in pairs or triplets to provide greater stability to the slat unit being tilted. Such means for holding the first and second lines to the slat unit may take the form of a bridging line connected to the first and second lines adjacent the slat unit. The bridging line may take the form of multiple lines and pass beneath as well as over the slat unit between the first and second lines.

Means is also provided for moving the first and second lines simultaneously in opposite direction to tilt the slat unit. It is anticipated that multiple slat units will be used in a venetian blind system generally one above the other. Where this is the case, tilting the slat units toward the vertical direction will cause hinging of the second members downwardly. Such motion will cause the second member to touch the adjacent slat unit, in this regard, causing the venetian blind structure to seal light, air, and sound from one side of the venetian blind structure to the other side thereof. It should be noted that the individual slat unit of the system of the present invention may be formed such that the first member width dimension is smaller than the second member width dimension.

A third line may also be used with the venetian blind structure of the present invention to provide lifting of the blind structure and to stack the slat members thereby. Such third line may pass through the first member and not interfere with the hinging effect heretofore described. Further, an eyelet may be formed in the first member to reinforce the same relative to the stress applied by the third line thereto. Such eyelet would not be visible to an observer viewing the blind when the blind is in the closed position.

It may be apparent that a novel and useful venetian blind structure has been described.

It is therefore an object of the present invention to provide a venetian blind structure including an articulated slat unit which produces an appearance of a monolithic fabric drape by sealing air gaps normally found in a conventional venetian blind structure between the blind slats.

Another object of the present invention is to provide a venetian blind structure which may possess relatively durable slat structures having metallic cores and fabric covered exteriors.

It is another object of the present invention to provide a venetian blind structure which eliminates the center hole found in each slat of a conventional venetian blind, thus eliminating a potential of breakage of the venetian blind structure resulting from normal usage.

A further object of the present invention is to provide a venetian blind structure which is easier to repair than a conventional venetian blind.

Yet another object of the present invention is to provide a venetian blind structure which is compatible with known tilting and lifting techniques.

The invention possesses other objects and advantages especially as concerns particular characteristics in features thereof which will become apparent as the specification continues.

BRIEF DESCRIPTION OF THE DRAWINGS

FIG. 1 is a perspective view of a plurality of slat units of the present invention in use together on a venetian blind structure.

FIG. 2 is a sectionally view taken along line 2—2 of FIG. 1.

FIG. 3 is a perspective schematic view of a slat of the prior art venetian blind systems.

FIG. 4 is a broken, exploded perspective view of a portion of a slat of present invention.

FIG. 12 is a sectional of a slat unit showing a first alternate embodiment of the present invention.

FIG. 13 is a sectional view of a slat unit showing a second alternate embodiment of the present invention.

FIG. 14 is a sectional view showing a third alternate embodiment of the present invention.

Figure 5:
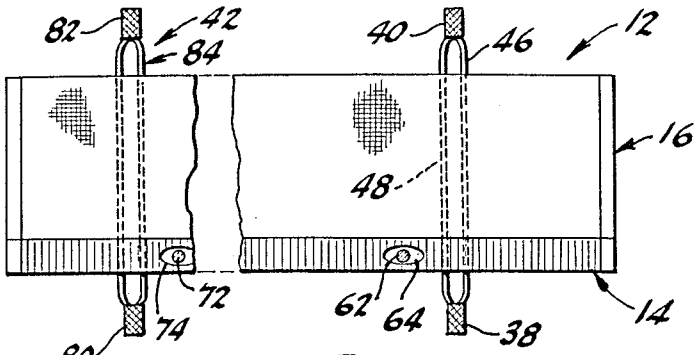
FIG. 5 is a top broken view of a slat unit of the present invention.

For a better understanding of the invention reference is made to the following detailed description of the preferred embodiments of the invention which should be referenced to the hereinabove described drawings.

DESCRIPTION OF THE PREFERRED EMBODIMENTS

Various aspects of the present invention will evolve from the following detailed description of the preferred embodiments which should be referenced to the hereinabove described drawings.

The embodiment as a whole is shown in the drawings by reference character 10. The venetian blind structure 10 includes as one of its elements a slat unit 12 having first member 14 and second member 16. First member 14 is hingedly attached to second member 16 at hinge portion 18, FIGS. 1 and 2. With reference to the drawings, first member 14 includes a first edge portion 20 and a second edge portion 22. Likewise, second member 16 includes a first edge portion 24 and a second edge portion 26. It should be obvious that second edge portion 22 of first member 14 lies immediately adjacent first edge portion 24 of member 16. First member 14 includes a metallic core 28 while second member 16 includes a metallic core 30. It should be realized, that cores 28 and 30 may be of other rigid or semi-rigid material such as plastic, wood, and the like. Cores 28 and 30 are wrapped by a fabric sheet 32 and pinched or bound at sew line 34. Sew line 34 represents the line of demarcation between first member 14 and second member 16. Since sheath 32 is generally formed of a fabric type material, first member 14 hinges or flexes at sew line 34 relative to second member 16 as will be further described hereinafter. With reference to FIG. 4, it may be observed that core 30 enters sheath 32 according to directional arrow 36, during the manufacturing process.

Returning to FIG. 1, it may be seen that a pair of tilt lines 38 and 40 are provided. Means 42 is also included for holding first and second tilt lines 38 and 40 to the edges 20 and 26 of slat unit 12. Such means may take the form of bridging lines 46, and 48, FIGS. 1 and 5. It should noted, that bridging lines 46 and 48 pass beneath slat unit 12. Bridging lines 46, and 48 are fastened to tilting lines 38 and 40. Thus, the movement of tilting lines 38 and 40 in opposite directions will tilt or slant slat unit 12. Directional arrows 50 and 52 represent the motion of tilting lines 38 and 40, FIG. 1. Bridging lines 46 and 48 may be replaced by a single line.

Figure 11:
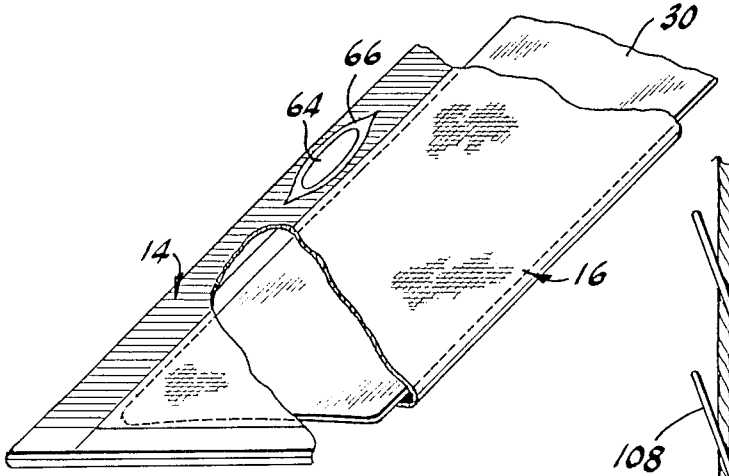
FIG. 11 is a broken away perspective view of a portion of a typical the present invention.

Turning to FIG. 3, a prior art rendition of a venetian blind is depicted. A prior art slat 54 includes a slot 56 which surrounds a lifting line 58. Unfortunately, the use of lifting line 58 to stack a number of slats, such as slats 54, also tends to bend or break slat 54 along fold 60. Returning to FIGS. 1 and 2, structure 10 also includes a lifting line 62 which passes through an eyelet or slot 64 of first member 14. With reference to FIG. 11, an eyelet may be formed with a reinforcement 66 of metal fabric or like material.

Figure 6:
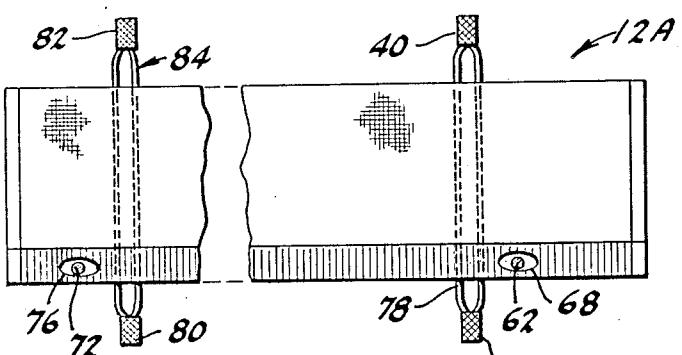
FIG. 6 is a top broken plan view of another slat unit of the present invention.

With reference to FIG. 1, slat unit 12 is employed with similar slat units 12A and 12B. It should be noted that eyelet 68 of slat unit 12A is located on the opposite side of tilting line 38 relative to slat unit 12. Slat unit 12B is identical to slat unit 12 in this regard since eyelet 70 of slat unit 12B lies in the same side of tilting line 38 as it does in slat unit 12. With reference to FIGS. 5 and 6, slat units 12 and 12A are depicted in plan view. Slat 12 and 12A include a pair of lifting lines 62 and 72 passing through eyelets 64 and 68 and eyelets 74 and 76, respectively. Lifting lines 62 and 72 form an open loop around the bridging lines 46, and 48 of slat unit 12 as well as the bridging lines 78 of slat unit 12A. Lifting lines 62 and 72 raise the slat structure 10 by stacking the slat units such as unit 12, in the conventional manner by movement along directional arrow 65. As shown in FIG. 1, tilt lines 38 and 40 are distinct from and do not interfere with the lift lines 62 and 72. Of course, slat units 12 and 12A, as depicted in FIGS. 5 and 6, also included additional tilting lines 80 and 82 which includes bridging lines 84.

Turning to FIGS. 12–14, embodiments 10, 10B and 10C are shown for the venetian blind structure of the present invention. Embodiment 10A includes a first member 86 and a second member 88 within a sheath 90. Second member 88 includes a core 92 while first member 86 does not include a core. Strength is provided first member 86 by sewing or stiffening the fabric of sheath 90 by conventional means.

FIG. 12 depicts a first member 94 and a second member 96. Second member 96 includes a body 98 which is laminated to a sheet of fabric 100. First member 94 includes an extension of fabric sheet 100.

Finally, embodiment 10C includes a body 102 with fabric sheet 104 shortened such that it is laminated only to a portion of body 102. It should be noted that in embodiments 10A, 10B and 10C a hinged area 18 is included between first and second members shown therein.

Figure 10:
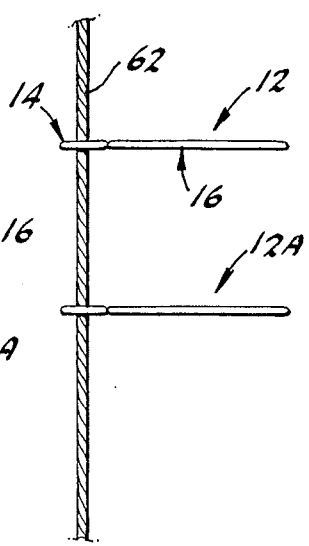
FIGS. 8–10 represent schematic end views of the slat units of the present invention between open and closed configurations.
Figure 9:
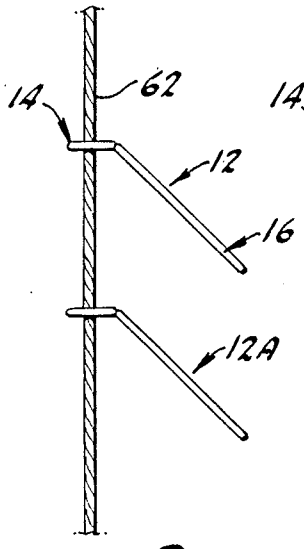
Figure 8:
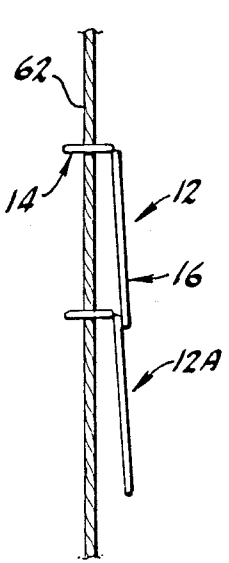
Figure 7:
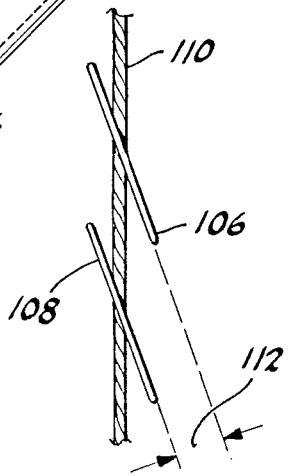
FIG-7 PRIOR ART
FIG. 7 is a schematic view showing a pair of slats in a prior art venetian blind system.

In operation, the user employes means for moving first and second tilt lines 38 and 40, FIG. 1 as well as tilt lines 80 and 82, FIGS. 5 and 6. Slats 12, 12A, and 12B will then slant or tilt from the position shown in FIG. 10, comparable to FIG. 1, to a position depicted in FIG. 8. It should be noted that the bridging lines are not depicted in FIGS. 8 through 10. However, FIG. 8 depicts second member 16 of slat unit 12 contacting slat unit 12A. In this position, there are no gaps between slat unit 12 and slat unit 12A. This permits the isolation of light, air, sound, and the like from one side of structure 10 to the other side thereof. With reference to FIG. 7 it should be noted that prior art slat units 106 and 108 are depicted therein with a central lifting line 110. A gap 112 necessarily exist between prior slats 106 and 108, since lifting line 110 is rather large. On the other hand, the unit of the present invention as shown in operation, FIGS. 8-10, must only accommodate the rather thin bridging lines between slat units 12 and 12A.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A venetian blind structure comprising:

a. a slat unit including a first member having first and second edge portions, and a second member having first and second edge portions, said second edge portion of said first member being hingedly attached to said first edge portion of said second member;

b. a first line, said first line including means for holding said first line relative to said first member of said slat unit;

c. a second line, said second line including means for holding said second line relative to said second member of said slat unit, said member holding said first line relative to said first member and said second line relative to said second member including a bridging line connected to said first and second lines said bridging line spanning the slat unit between said first and second lines; and d. means for moving said first and second line simultaneously in opposite directions.

2. The venetian blind structure of claim 1 in which said first and second members each include a width dimension, said first member width dimension being narrower than said second member width dimension.

3. The venetian blind structure of claim 3 in which said slat unit first member includes a core member surrounded by a sheath.

4. The venetian blind structure of claim 3 in which said slat unit second member includes a core member surrounded by a sheath.

5. The venetian blind structure of claim 4 in which said sheaths of said first and second members are a generally unitary member brought together at an area separating said first and second core members, to form a pair of pockets enclosing said first and second core members.

6. The venetian blind structure of claim 1 in which said slat unit is a first slat unit and said venetian blind structure further comprises a second slat unit disposed adjacent said first slat unit, said second edge portion of said second member being hingedly rotatable to contact said second slat unit.

7. The venetian blind structure of claim 1 which additionally comprises a third line, said third line being an element of means for lifting said slat unit.

8. The venetian blind structure of claim 7 in which said third line passes through said first member of said slat unit.

9. The venetian blind structure of claim 8 which additionally includes an eyelet positioned in said first member, said third line passing through said eyelet.

10. The venetian blind structure of claim 7 in which said means for holding said first line relative to said first member and said second line relative to said second member includes a bridging line connected to said first and second lines, said bridging line spanning the slat unit between said first and second lines, said third line looping said bridging line.

* * * * *